US008438735B2

(12) United States Patent
De Klerk

(10) Patent No.: US 8,438,735 B2
(45) Date of Patent: May 14, 2013

(54) RAZOR

(75) Inventor: John Christopher De Klerk, Cape Town (ZA)

(73) Assignee: Valeo Trade and Invest 3 (Pty) Ltd., Bishopscourt (ZA)

( * ) Notice: Subject to any disclaimer, the term of this patent is extended or adjusted under 35 U.S.C. 154(b) by 485 days.

(21) Appl. No.: 12/597,073

(22) PCT Filed: Sep. 4, 2007

(86) PCT No.: PCT/ZA2007/000056

§ 371 (c)(1),
(2), (4) Date: Oct. 22, 2009

(87) PCT Pub. No.: WO2008/134776

PCT Pub. Date: Nov. 6, 2008

(65) Prior Publication Data

US 2010/0115774 A1 May 13, 2010

(30) Foreign Application Priority Data

Apr. 26, 2007 (ZA) ..... 2007/03439

(51) Int. Cl.
*B26B 19/40* (2006.01)

(52) U.S. Cl.
USPC ..... 30/41; 30/41.5; 30/50

(58) Field of Classification Search ..... 30/41, 41.5, 30/535, 538, 541, 50
See application file for complete search history.

(56) References Cited

U.S. PATENT DOCUMENTS

| | | | | | |
|---|---|---|---|---|---|
| 2,327,192 | A | * | 8/1943 | Keene | 30/41 |
| 2,866,265 | A | * | 12/1958 | Kells | 30/41 |
| 3,139,683 | A | * | 7/1964 | Waldman | 30/41 |
| 3,417,468 | A | * | 12/1968 | Miyauchi | 30/41 |
| 3,726,009 | A | * | 4/1973 | Hackmyer | 30/41 |
| 4,077,119 | A | | 3/1978 | Sellera | |
| 4,177,556 | A | * | 12/1979 | Galli, Jr. | 30/41 |
| 4,653,188 | A | * | 3/1987 | Kwak | 30/41 |
| 4,809,432 | A | * | 3/1989 | Schauble | 30/41 |
| 5,141,349 | A | * | 8/1992 | Maguire et al. | 30/41 |
| 5,241,751 | A | | 9/1993 | Goh | |
| 5,337,478 | A | * | 8/1994 | Cohen et al. | 30/41.5 |
| 5,402,573 | A | * | 4/1995 | Laniado | 30/41 |
| 5,402,697 | A | * | 4/1995 | Brooks | 30/41 |
| 5,564,190 | A | * | 10/1996 | Fleetwood | 30/41 |
| 5,983,500 | A | | 11/1999 | da Silva | |

(Continued)

FOREIGN PATENT DOCUMENTS

| | | | |
|---|---|---|---|
| CH | 653595 | A5 * | 1/1986 |
| EP | 2139649 | B1 * | 11/2010 |

(Continued)

OTHER PUBLICATIONS

International Search Report issued Dec. 19, 2007 in International (PCT) Application No. PCT/ZA2007/000056.

(Continued)

*Primary Examiner* — Jason Daniel Prone
(74) *Attorney, Agent, or Firm* — Wenderoth, Lind & Ponack, L.L.P.

(57) ABSTRACT

A razor which includes a head, at least two spaced apart razor blades mounted to the head, and structure for expelling a shaving composition from the head, at least between the blades, onto a surface to be shaved.

16 Claims, 7 Drawing Sheets

U.S. PATENT DOCUMENTS

| | | | | |
|---|---|---|---|---|
| 6,305,082 | B1 * | 10/2001 | Troncoso | 30/41.5 |
| 6,499,218 | B2 * | 12/2002 | Rocha | 30/41 |
| 6,754,958 | B2 * | 6/2004 | Haws et al. | 30/41 |
| 6,789,321 | B2 * | 9/2004 | Simms | 30/41 |
| 6,910,274 | B1 * | 6/2005 | Pennella et al. | 30/41 |
| 7,121,754 | B2 * | 10/2006 | Bressler et al. | 30/535 |
| 7,681,314 | B2 * | 3/2010 | Follo | 30/41.5 |
| 7,752,757 | B2 * | 7/2010 | Salvatore, Jr. | 30/41 |
| D644,787 | S * | 9/2011 | Wain | D28/7 |
| 8,327,544 | B2 * | 12/2012 | De Klerk et al. | 30/41 |
| 2001/0003869 | A1 | 6/2001 | Rocha | |
| 2002/0144404 | A1 * | 10/2002 | Gilder et al. | 30/41 |
| 2005/0050731 | A1 * | 3/2005 | Mislove | 30/41 |
| 2005/0120560 | A1 * | 6/2005 | Franzini et al. | 30/41 |
| 2005/0126008 | A1 | 6/2005 | Pennella et al. | |
| 2005/0138814 | A1 * | 6/2005 | Pennella et al. | 30/41 |
| 2005/0144786 | A1 * | 7/2005 | Bressler et al. | 30/41 |
| 2005/0241664 | A1 * | 11/2005 | Mislove | 30/41.5 |
| 2006/0260131 | A1 * | 11/2006 | Follo | 30/50 |
| 2007/0214646 | A1 * | 9/2007 | Bezdek | 30/41 |
| 2008/0155831 | A1 * | 7/2008 | Royle | 30/41 |
| 2008/0289185 | A1 * | 11/2008 | Clarke | 30/41.5 |
| 2008/0307653 | A1 * | 12/2008 | Wattam | 30/41 |
| 2010/0095530 | A1 * | 4/2010 | De Klerk et al. | 30/41.5 |
| 2010/0236071 | A1 * | 9/2010 | Szczepanowski et al. | 30/41.5 |
| 2010/0236072 | A1 * | 9/2010 | Szczepanowski et al. | 30/41.5 |
| 2011/0146080 | A1 * | 6/2011 | Pauw | 30/41.5 |
| 2011/0289776 | A1 * | 12/2011 | Hawes et al. | 30/41 |

FOREIGN PATENT DOCUMENTS

| | | | |
|---|---|---|---|
| EP | 2139650 | B1 * | 12/2010 |
| ES | 2358035 | T3 * | 5/2011 |
| ES | 2361811 | T3 * | 6/2011 |
| FR | 2583672 | A1 * | 12/1986 |
| FR | 2634154 | A1 * | 1/1990 |
| JP | 04231909 | A * | 8/1992 |
| WO | 2005/087040 | | 9/2005 |
| WO | WO 2005087040 | A1 * | 9/2005 |
| WO | WO 2008134776 | A1 * | 11/2008 |
| WO | WO 2008134777 | A1 * | 11/2008 |

OTHER PUBLICATIONS

Patent Cooperation Treaty (PCT) International Preliminary Report on Patentability issued Aug. 10, 2009 in International Application No. PCT/ZA2007/000056.

* cited by examiner

RAZOR

BACKGROUND OF THE INVENTION

This invention relates to a razor of the kind which includes two or more razor blades which are movable with a shaving action, by a user, over a region which is to be shaved.

A razor of the aforementioned kind is normally used in conjunction with a soap or lather, a gel or cream, or any other suitable preparation (collectively referred to herein as "a shaving composition") which may facilitate or enhance the shaving process.

It has been proposed to combine a container, which contains a shaving composition, with a shaving head which carries a razor blade. Pressure is applied to the shaving composition in any suitable way, for example by internally pressurizing the container or by squeezing the container, manually or through the use of a suitable device, to expel the shaving composition from the shaving head directly onto a zone which is being shaved. Prior art documents which are relevant to this type of operation include the following: U.S. Pat. No. 7,178,241, U.S. Pat. No. 7,121,754, U.S. Pat. No. 6,807,739, U.S. Pat. No. 5,664,330, U.S. Pat. No. 5,655,302, U.S. Pat. No. 5,564,190, U.S. Pat. No. 5,168,628, U.S. Pat. No. 4,753,006, U.S. Pat. No. 4,653,188, U.S. Pat. No. 4,562,643, U.S. Pat. No. 4,074,429, U.S. Pat. No. 3,895,437, US2007/017097, US2005/132574, US2002/0157255 and DE4335449.

Typically the prior art devices described in the aforementioned citations are concerned with directing a shaving aid material to a head of a razor. For example in U.S. Pat. No. 7,121,754 the shaving aid is directed to a plurality of ports on a shaving head which surround a razor cartridge. In US2002/0157255 a soap film is deposited ahead of a leading blade in a blade cartridge. In US2006/0272154 a shaving gel is dispensed from a handle of a razor through a manifold which extrudes the gel into laminar-flow paths that emanate outwardly from around a pivoting multi-bladed cartridge.

In general terms the prior art devices, of which the applicant is aware, are primarily concerned with directing a shaving composition to a zone or region, adjacent one or more razor blades, which is to be shaved. Although these devices do provide, to some extent, a convenience factor a user is still required to go through a conventional shaving process. Thus the blade or blades in the razor must be cleaned at regular intervals during the shaving process for hairs and hair follicles can be trapped, particularly between blades in a multi-bladed cartridge. This trapped material creates a sensation of drag as the razor is drawn over the skin and blunts the blades fairly rapidly.

It is an object of the invention to provide a razor in which the likelihood of the entrapment of shaved material such as hair and hair follicles during a shaving process is reduced so that the shaving experience is thereby enhanced, and blade life is extended.

SUMMARY OF THE INVENTION

The invention provides, in the first instance, a razor which includes a head, at least two spaced apart razor blades mounted to the head, and structure for expelling a shaving composition from the head, at least between the blades, onto a surface to be shaved.

The structure may be of any appropriate kind and preferably includes at least one passage which extends from a source of the shaving composition to the head and a mechanism for delivering shaving composition from the source through at least one passage to the head.

The mechanism may be operated in any appropriate way e.g. manually, electrically or the like. In general terms the mechanism is designed to apply pressure to the shaving composition so that it then passes along the at least one passage to the head. For example the shaving composition may be housed in a flexible tube which is squeezed manually or by the use of a mechanical aid to expel shaving composition from the tube. Another possibility is to house the shaving composition in a pressurised container and to use gas pressure to expel shaving composition from the container in a controlled manner. An electrically or mechanically activated pump or displacement mechanism, which can be operated in a controlled manner, can also be used to deliver the shaving composition from the source through the at least one passage. Mechanisms to achieve this function are available in the prior art and for this reason are not further described herein.

Preferably the head is formed with a manifold in which the razor blades are at least partly located and the at least one passage from the source terminates in the manifold.

The razor may include at least two of the passages which terminate at respective spaced apart locations in the manifold.

The razor blades may be carried by a cartridge which is releasably engaged with the manifold. The cartridge may have an outer surface which is sealingly engaged, in a leak-proof manner, with an opposing surface of the manifold. In this way an effective plenum can be formed inside the manifold, upstream of the razor blades, from which the shaving composition is then expelled, in an evenly distributed and smooth flowing manner between the blades to a surface to be shaved.

The source of the shaving composition may be attached to or mounted in or otherwise fixed to a body of the razor.

The head may be mounted to the body for limited movement relative to the body. A biasing element may act between the body and the head and tend to bias the head to a predetermined position relative to the body. This is to ensure that, as far as is possible under the circumstances, the razor blades are orientated, relatively to a surface to be shaved, at an optimum attack angle.

The invention also extends to a razor which includes a body, a source of a shaving composition attached to the body, a head which is on the body and in which is formed a manifold, at least two spaced apart razor blades located, at least partly, inside the manifold, at least one passage which extends from the source to the manifold, and a mechanism for delivering shaving composition in a controlled manner from the source through the at least one passage to the manifold, from where the shaving composition is expelled, at least between the blades, onto a surface to be shaved.

The head may be movable to a limited extent relative to the body against the action of a biasing element. This movement may be used to operate the mechanism so that the shaving composition is only delivered when needed.

The blades in the razor are preferably mounted to a cartridge which, on an external surface, is engageable in a leak-proof manner with a surrounding surface of the manifold.

A plenum may be formed inside the manifold from where the shaving composition is expelled at least between the blades.

In a variation of the invention a plenum is formed inside the cartridge and at least one passage is formed through a wall of the cartridge, the arrangement being such that the shaving composition can pass to the plenum and can then be expelled at least between the blades.

The invention also extends to a cartridge for use in a razor which includes a housing with an outer side and an inner side, an opening in the housing which extends between the outer side and the inner side, and at least two razor blades which are spaced apart and which are positioned at least partly in the opening with cutting edges of the blades projecting on the outer side from the opening, and wherein the opening on the inner side, in use of the cartridge, is connected to a source of a shaving composition. In one form of the invention the opening, between the blades and the inner side, defines a plenum and at least one passage is formed through a wall of the housing through which the shaving composition can pass to the plenum.

BRIEF DESCRIPTION OF THE DRAWINGS

The invention is further described by way of examples with reference to the accompanying drawings in which.

DESCRIPTION OF PREFERRED EMBODIMENTS

Figure 1:
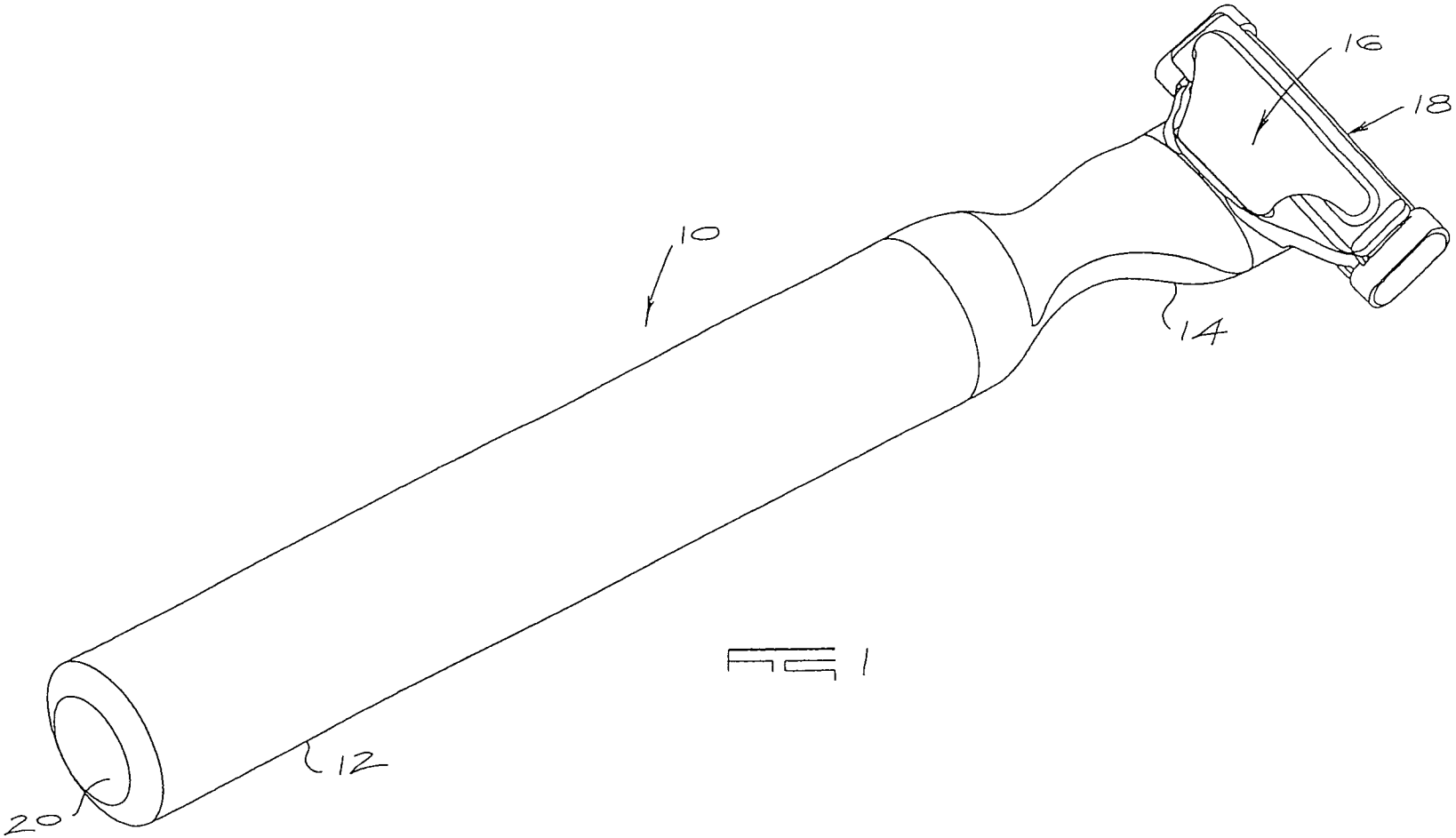
FIG. 1 is a view of a razor according the invention.

FIG. 1 of the accompanying drawings is an external view of a razor 10 according to the invention which includes a body 12, a holder 14, a head 16 and a blade cartridge 18. The holder 14 is made from first and second interengaged parts 14A and 14B respectively—see FIG. 3.

The body 12 is elongate and includes a cap 20 at one end. A canister 22 which contains a shaving composition is positioned inside the hollow interior of the body (see FIG. 2). The canister can take on various forms. In one example of the invention the canister is internally pressurised by means of a gas and includes a release valve, not shown, which allows for a controlled release of shaving composition from the canister under control of a user. This arrangement is given only by way of example and is non-limiting. In a variation of the invention the body 12 is flexible and may, itself, form a wall of the canister. The flexible body can be manually compressed or squeezed to pressurise its interior and thereby cause shaving composition to be expelled through a suitably positioned port, not shown. It is also possible to make use of a mechanically or electrically operated mechanism which, for example, drives a plunger inside the canister thereby to pressurise the shaving composition inside the canister, in a controlled way. Shaving composition is thereby expelled from an exhaust port of the canister, according to requirement.

Examples of the aforementioned types of shaving composition expelling mechanisms are known in the art and, for this reason, are not further described herein.

Figure 2:
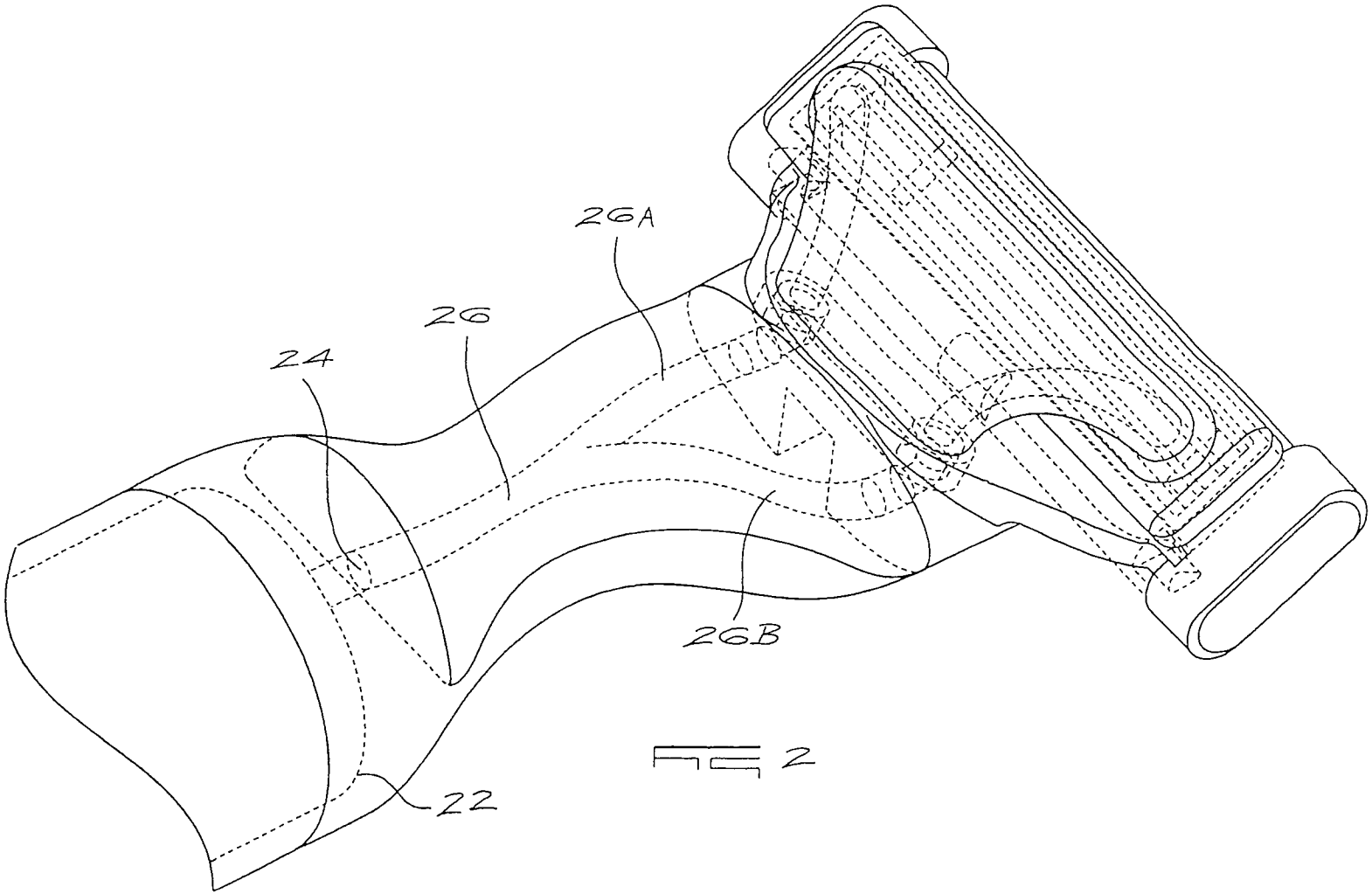
FIG. 2 illustrates, in enlarged detail, an inner construction of part of the razor near a shaving end.
Figure 3:
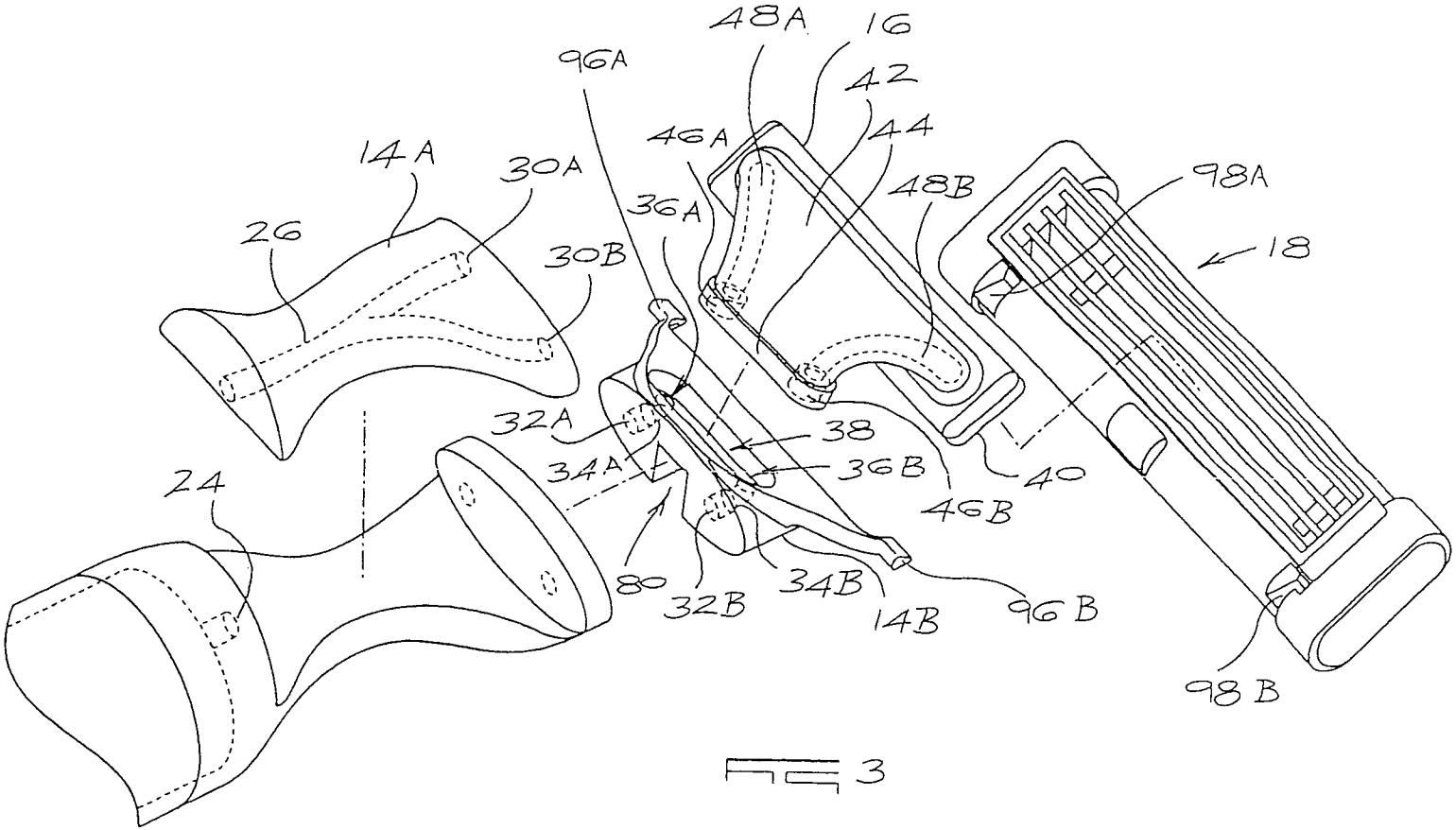
FIG. 3 illustrates components shown in FIG. 2 on an enlarged scale and in an exploded configuration.

As is shown in FIGS. 2 and 3 an exit port 24 at one end of the body which is mated in a leak-proof manner with a discharge outlet from the canister, leads to a passage 26 in the first holder part 14A. The passage forks into sub-passages 26A and 26B respectively which terminate in respective exits 30A and 30B. These exits mate, in a leak-proof manner, with mouths 32A and 32B at one end of the second holder part 14B. Short passages 34A and 34B extend through the second holder part 14B from the mouths 32A and 32B respectively and terminate in ports 36A and 36B respectively. These ports are located in a relatively large oval recess 38.

The razor head 16 has a fairly large rectangular body 40 from which extends a curved neck 42 which is slightly flexible. The neck terminates in an oval collar 44 which is engageable in a leak-proof and secure manner with the recess 38. The ports 36A and 36B are thereby placed in communication with openings 46A and 46B. The openings lead to respective passages 48A and 48B which terminate in a relatively smaller volume inside the rectangular body 40. Alternatively, the passages 48A and 48B are absent, and the openings 46A and 46B provide direct access to a relatively large volume 48 inside the neck 42—see FIG. 4.

An important aspect in this regard is that the shaving composition should be delivered to a volume, immediately upstream of the cartridge 18, which then allows for, and promotes, a smooth and evenly distributed flow of the shaving composition through the cartridge.

The cartridge 18 is designed to engage with an underside of the body 40, as is hereinafter described.

The razor of the invention is compact and self-contained and includes the blade cartridge, the body of the razor and the shaving composition in one system. Ease of operation results.

Figure 4:
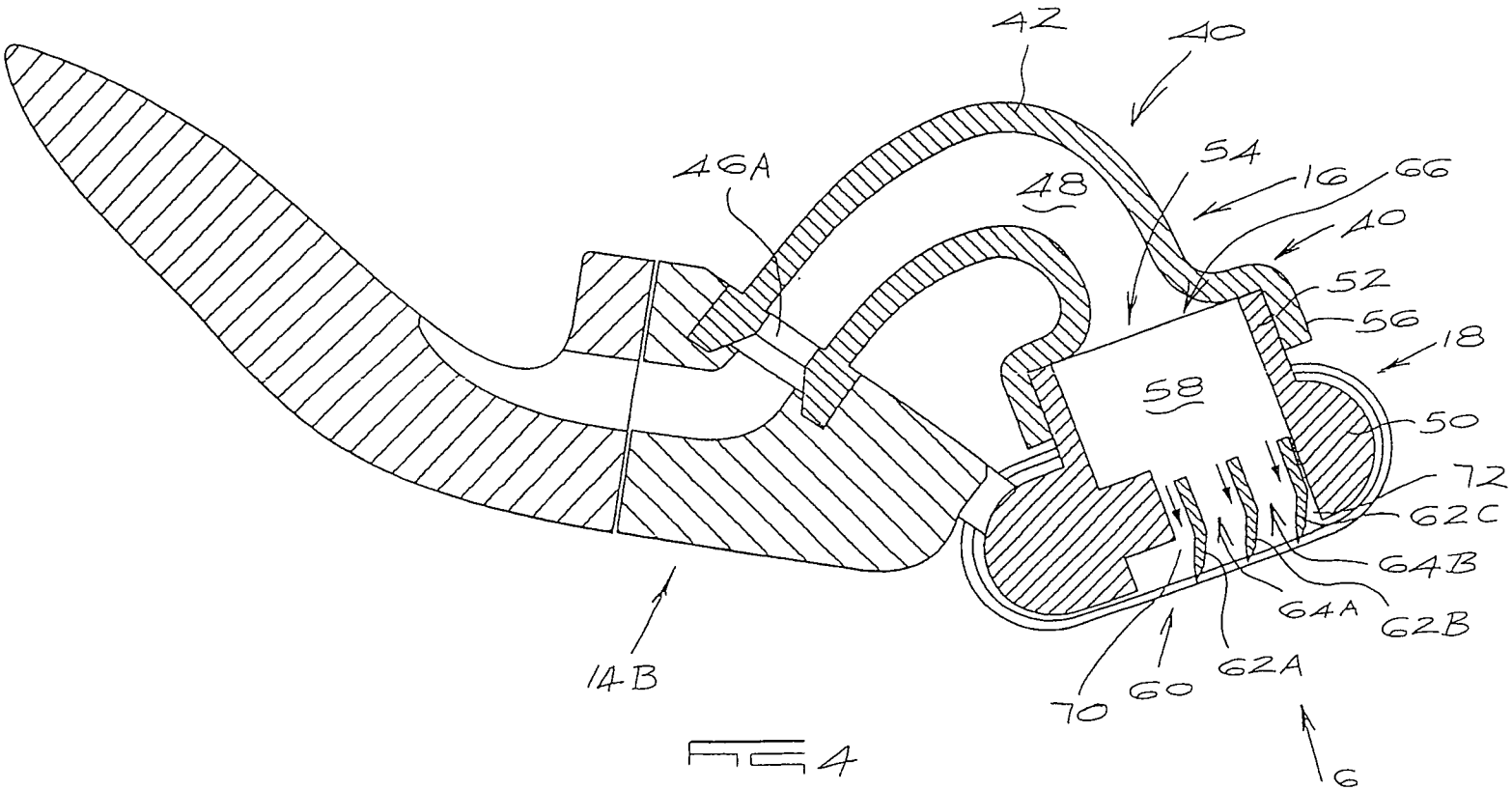
FIG. 4 is a cross-sectional view of part of the razor, taken near the shaving head, in an off-centre line position.

FIG. 4 is a cross-sectional view of the cartridge 18 engaged with the head 16 and with the head attached to the holder 14, on an enlarged scale. This cross-sectional view is taken on a line which is displaced from a longitudinal centerline of the razor.

The cartridge 18 has a housing 50 which, in outline, is substantially rectangular. A flange 52 on what, in use, is an inner side 54 of the cartridge is engaged with a surrounding wall 56 of the body 40. This is a leak-proof connection.

The housing 50 includes an opening or volume 58 which extends from the inner side 54 to an outer side 60 of the housing. Mounted inside the opening are three razor blades designated 62A, 62B and 62C respectively. The blades are parallel to and are spaced apart from one another and are supported by suitable formations at their respective opposing ends only so that, between the adjacent blades 62A and 62B, and 62B and 62C, respectively, pathways 64A and 64B are formed.

When the flange 52 is engaged with the wall 56 a manifold 66 is defined inside the housing by the volume 48 (or the passages 48A and 48B) and the volume formed by the opening 58 upstream of the razor blades. The manifold can be exited via the pathways 64A and 64B. It is also possible to form an exit pathway 70 on a leading side of the blade 62A (referred to herein as the leading blade) and an exit pathway 72 on a trailing side of the blade 62C (referred to herein as the trailing blade).

The number of blades included in the cartridge can be varied according to requirement. Thus the cartridge can include at least two blades, and up to four, five or even six blades.

Ideally the total cross-sectional area of the exit pathways 64A, 64B, 70 and 72 is smaller than the total cross-sectional area of the two openings 46A and 46B. Consequently when the shaving composition flows into the manifold these volumes become pressurised and effectively act as a plenum 76. This characteristic helps to promote a smooth, consistent and even flow of the shaving composition from the cartridge.

Figure 5:
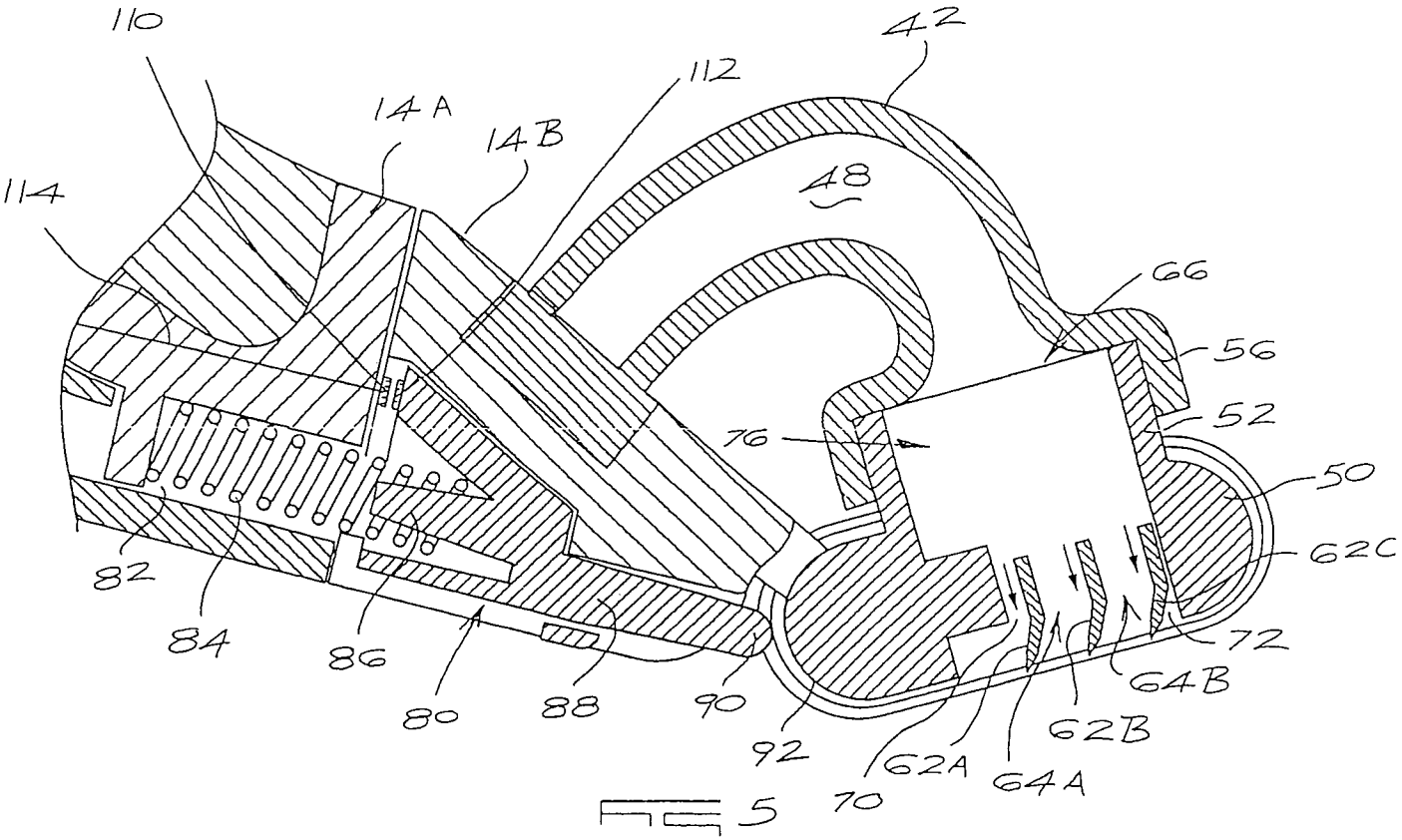
FIG. 5 is similar to FIG. 4 but taken on a centre line position.

FIG. 5 is a view which is similar in many respects to FIG. 4 and for this reason the structure shown in FIG. 5 is not fully described. FIG. 5 is however taken on a longitudinal centerline of the razor 10.

Figure 6:
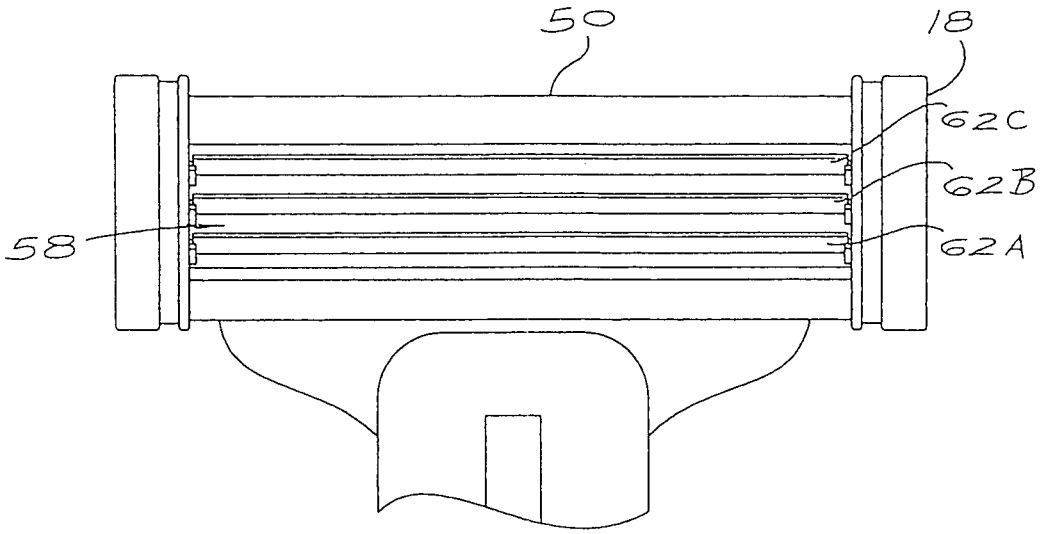
FIG. 6 is an end view of a cartridge used in the razor of the invention in the direction of an arrow marked 6 in FIG. 4.

FIG. 6 shows the cartridge 18 in the direction of arrow 6 in FIG. 4. The housing 50, on the outer side 60, surrounds the opening 58 and the three blades 62A, 62B and 62C which are spaced apart from each other extend across the opening protruding slightly on the outer side. The cartridge has a flexible surround which can readily deform, in use of the razor, to ensure that the cutting edges of the blades come into close contact with a surface which is to be shaved. The extent to which the blades protrude is known in the art and is not further described herein. It should be pointed out that the blades are fixed, under factory conditions, to the housing of the cartridge and are supplied in a ready-to-use form. Also the cartridge, once engaged with the head 16 (mounted to the remainder of the razor) ensures that the razor blades are presented at an optimum attack angle to a surface which is to be shaved. Once the blades have been used to an extent that they become blunt and can no longer function satisfactorily the cartridge is disposed of and a fresh cartridge takes its place.

The neck 42, as stated, is made from a flexible material which can bend with a slight resilient action during use of the razor. The second holder part 14B at a central lower location is formed with a fairly deep channel 80 which opposes a recess 82 in the first holder part 14A. A small spring 84 is positioned inside the recess and is engaged with a pin 86 which extends to one side of a movement-transmitting member 88 located in the recess. On an opposing side the member 88 has a rounded projection 90 which bears against a curved surface 92 of the cartridge housing 50.

The holder part 14B has two projections 96A and 96B which extend forwardly and outwardly relative to the body 12. These projections are engageable with small recesses 98A and 98B respectively, in the cartridge housing 50 in a way which secures the cartridge to the holder but which allows the cartridge to pivot slightly relatively to the holder part.

Figure 8:
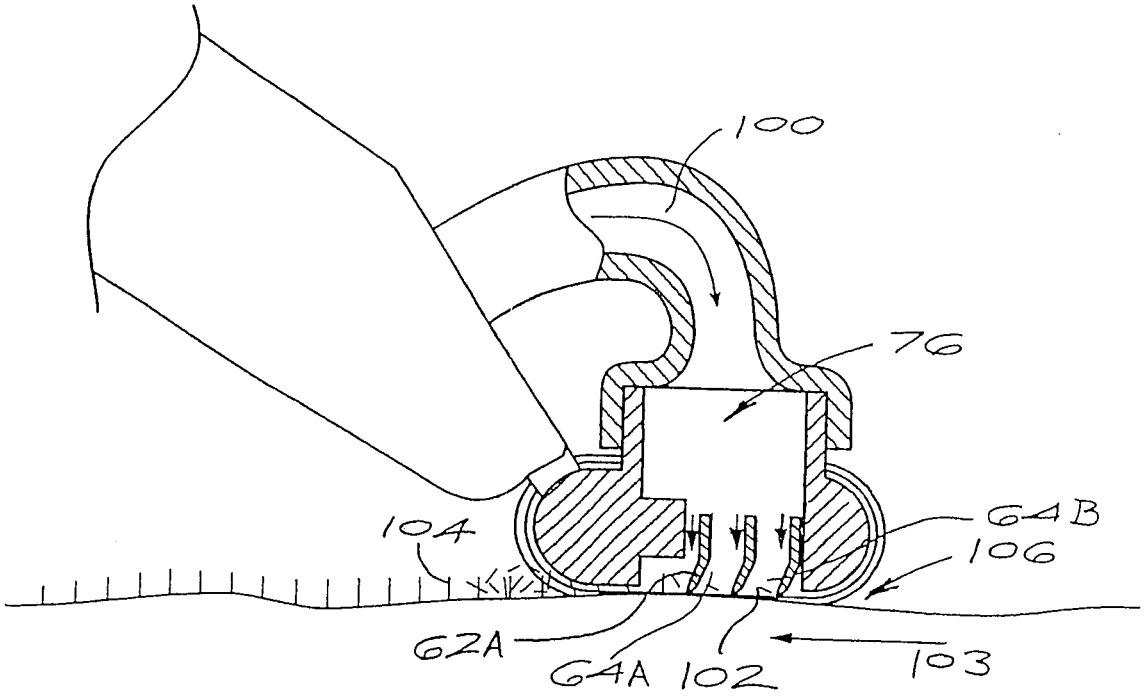
FIG. 8 is a view from one side illustrating a benefit which arises through the use of the razor of the invention.

FIG. 8 schematically illustrates a primary beneficial aspect arising from the use of the razor. The shaving composition carried in the body 12 is expelled through the passage 26 and then through the sub-passages 26A and 26B into the plenum 76. The shaving composition, designated 100 in FIG. 8, is slightly pressurised inside the plenum 76 and then exits the plenum by flowing at least through the pathways between the blades. The shaving composition 100 is expelled together with hair and hair follicles 102 which have been shaved, along the pathways 64A and 64B between the blades. In FIG. 8 the razor is moved from right to left in the direction of an arrow 103 and the leading blade 62A strikes hairs 104 on a skin area 106 which is being shaved.

It has been found through tests that the quantity of shaving composition used while shaving with the razor of the invention is generally reduced compared to prior art devices known to the applicant. The shaving composition which flows between adjacent sets of blades ensures that hairs and hair follicles which under other conditions might become entrapped between the blades are expelled between the blades. In other circumstances a user would typically hold the razor head under running hot water and then ultimately tap the razor head on a surface to dislodge stubborn foreign material. This can result in blade damage.

A blunt blade, typically a blunt leading blade in an assembly of blades, causes drag and pull and interferes with the shaving experience.

As the shaving composition causes the foreign material to be displaced from the shaving region and from between the blades, the blade life becomes extended and the comfort level of the shaving experience is increased. The shaving composition can also be expelled from the blade cartridge ahead of the leading blade to provide a ready-to-shave coating on the skin 106.

The shaving composition is continuously expelled from between the blades and, optionally, ahead of the leading blade and behind the trailing blade, in a smooth evenly distributed manner and no residue is left between the blades. The shaving composition is directed to the skin only at the point of use and this means that an effective use is made of the composition.

Figure 7:
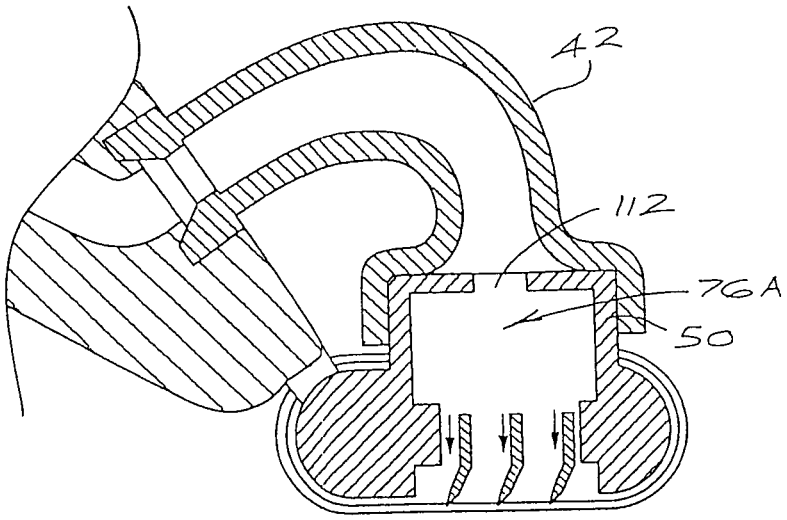
FIG. 7 is a view of a different cartridge which is coupled to a shaving head according to a variation of the invention.

FIG. 7 illustrates a variation to the configuration shown in FIG. 4 wherein a plenum designated 76A is effectively defined inside the cartridge housing 50. Ports 112 allow the plenum to be pressurised by shaving composition flowing into the plenum. In other respects however the arrangement shown in FIG. 7 functions in a similar way to what has been described hereinbefore.

The head 16 is movable during shaving to a limited extent relative to the body 12 by virtue of the flexible neck 42. Also the cartridge can pivot slightly around the joints between the projections and recesses 96A and 98A, and 96B and 98B, respectively. The degree of permitted movement and the ease with which movement takes place can be controlled by varying the characteristics of the material from which the neck 42 is made. The spring 84 can also be used for this purpose. The spring 84 or the resilience of the neck material, as the case may be, or both factors, tend to restore the head to a predetermined more or less optimal position relatively to the body which gives a correct razor blade attack angle but, on the other hand, these factors are capable of allowing for a limited amount of movement of the head relative to the body.

If the razor includes an electrically operated structure for dispensing shaving composition to the head then the relative movement referred to can be used to cause operation of an electrical actuator, under controlled conditions, which in turn controls the expulsion of shaving composition to the head. For example small sensing switch contacts 110 and 112 can be closed upon pivotal movement of the head 16 towards the body (see FIG. 5). An electrical lead 114 is connected to the contacts and the opening and closing of the contacts, in the manner described, is continuously monitored by a suitable controller (not shown). If the contacts are in one mode (open or closed) the controller determines that the razor is inoperative. If the contacts are in a second mode (closed or open) the controller interprets this as being caused by a shaving action.

In a different arrangement if the shaving composition is held, for example, in a gas-filled canister then under normal conditions gas cannot escape from the canister and the shaving composition is held securely inside the canister. The relative movement of the head can however be used to allow for a controlled release of gas from the canister. This, in turn, can cause the shaving composition to be fed to the shaving head in a controlled and reliable manner which is dependent on usage requirements. If the head pivots away from the body then the spring 84 helps to displace the member 88 to the right and the contacts are then opened.

It is possible for a controller to be used to control the supply of shaving composition in various ways in response to a shaving action. For example an actuator can be energised for a fixed period each time the sensing switch arrangement is actuated. A second possibility is for the actuator to be energised for the period for which the neck is held in a bent or flexed mode. Another possibility is for the actuator to be pulsed for short periods, at regular intervals, for the duration of the time for which a shaving action is being detected. Other possible modes of operation can be programmed into the controller.

The invention thus makes it possible for the shaving composition to be dispensed directly to a shaving zone according to the shaving requirements at the time. The shaving composition is applied to the shaving zone adjacent the razor blades and effective use is therefore made of the shaving composition.

When the contents of the container are depleted the container is removed and a fresh container takes its place.

The invention claimed is:

1. A razor comprising:

a body to which a source of a shaving composition is attachable;

a head which is on the body and which is mounted to the body for limited movement relative to the body;

an element which acts between the body and the head and which causes the head to be biased to a predetermined position relative to the body;

a cartridge on the head;

a plurality of razor blades engaged with the cartridge;

at least one passage which extends from the source; and a mechanism for delivering shaving composition in a controlled manner from the source, through the at least one passage, to be expelled onto a surface to be shaved, wherein the cartridge includes a housing having an outer side and an inner side, and an opening in the housing which extends between the outer side and the inner side, wherein the housing is engageable in a leak-proof manner with the head whereby shaving composition can pass from the at least one passage through the opening to the razor blades, wherein the at least one passage extends to the opening which, in use, is pressurised by shaving composition flow into the opening, wherein the razor blades are parallel to one another and are spaced apart from one another, and are mounted to the housing so as to be supported at respective opposing ends only, such that a flow passage is formed between adjacent ones of the razor blades, the flow passage extending from edges of the razor blades at the opening to cutting edges of the razor blades, the cutting edges of the razor blades projecting on the outer side of the housing, the edges of the razor blades at the opening and the cutting edges of the razor blades being at opposite ends of the razor blades, and wherein the shaving composition can pass from the opening and through the flow passage with a smooth, consistent and evenly distributed flow.

2. A razor according to claim 1, wherein the at least one passage which extends from the source forks into sub-passages which terminate at respective spaced apart locations in the opening.

3. A razor according to claim 1, wherein the cartridge is releasably engaged with the head.

4. A razor according to claim 1, wherein the cartridge has an outer surface which is sealingly engaged, in a leak-proof manner, with an opposing surface of the head.

5. A razor according to claim 4, wherein the cartridge has a flange which is engaged with a surrounding wall of the head.

6. A razor according to claim 1, wherein the opening is in communication with a volume upstream of the housing.

7. A razor according to claim 1, wherein the cartridge is pivotable relative to the head.

8. A razor according to claim 1, wherein the plurality of razor blades comprises three razor blades, wherein the flow passage comprises two flow passages formed between adjacent ones of the three razor blades, respectively, and wherein the shaving composition can pass from the opening and through the each of the flow passages with a smooth, consistent and evenly distributed flow.

9. A razor comprising:

a body to which a source of a shaving composition is attachable;

a head which is on the body;

at least one biasing element;

a movement transmitting member, wherein the head is movable to a limited extent, relative to the body, against the action of the at least one biasing element which acts on the head via the movement transmitting member;

a cartridge on the head;

a plurality of razor blades engaged with the cartridge;

at least one passage which extends from the source; and a mechanism for delivering shaving composition in a controlled manner from the source, through the at least one passage, to be expelled onto a surface to be shaved, wherein the cartridge includes a housing having an outer side and an inner side, and an opening in the housing which extends between the outer side and the inner side, wherein the housing is engageable in a leak-proof manner with the head whereby shaving composition can pass from the at least one passage through the opening to the razor blades, wherein the at least one passage extends to the opening which, in use, is pressurised by shaving composition flow into the opening, wherein the razor blades are parallel to one another and are spaced apart from one another, and are mounted to the housing so as to be supported at respective opposing ends only, such that a flow passage is formed between adjacent ones of the razor blades, the flow passage extending from edges of the razor blades at the opening to cutting edges of the razor blades, the cutting edges of the razor blades projecting on the outer side of the housing, the edges of the razor blades at the opening and the cutting edges of the razor blades being at opposite ends of the razor blades, and wherein the shaving composition can pass from the opening and through the flow passage with a smooth, consistent and evenly distributed flow.

10. A razor according to claim 9, wherein the at least one passage which extends from the source forks into sub-passages which terminate at respective spaced apart locations in the opening.

11. A razor according to claim 9, wherein the cartridge is releasably engaged with the head.

12. A razor according to claim 9, wherein the cartridge has an outer surface which is sealingly engaged, in a leak-proof manner, with an opposing surface of the head.

13. A razor according to claim 12, wherein the cartridge has a flange which is engaged with a surrounding wall of the head.

14. A razor according to claim 9, wherein the opening is in communication with a volume upstream of the housing.

15. A razor according to claim 9, wherein the cartridge is pivotable relative to the head.

16. A razor according to claim 9, wherein the plurality of razor blades comprises three razor blades, wherein the flow passage comprises two flow passages formed between adjacent ones of the three razor blades, respectively, and wherein the shaving composition can pass from the opening and through the each of the flow passages with a smooth, consistent and evenly distributed flow.

* * * * *